United States Patent [19]

Griffin et al.

[11] 4,185,265

[45] Jan. 22, 1980

[54] VEHICULAR MAGNETIC CODED SIGNALLING APPARATUS

[75] Inventors: Noel J. Griffin, Cincinnati; Larry D. Miller, Xenia; Gerald K. Squire, Middletown, all of Ohio; Carl E. Knochelmann, Jr., Ft. Wright, Ky.

[73] Assignee: Cincinnati Electronics Corporation, Cincinnati, Ohio

[21] Appl. No.: 805,189

[22] Filed: Jun. 9, 1977

[51] Int. Cl.[2] ..... G08G 1/09; E01F 11/00

[52] U.S. Cl. ..... 340/32; 324/226; 324/261; 404/9

[58] Field of Search ..... 340/32, 38 L, 31 R; 404/9; 364/443; 246/63 R, 63A, 64, 69, 175, 64C; 324/208, 226, 260, 261

[56] References Cited

U.S. PATENT DOCUMENTS

| | | | |
|---|---|---|---|
| 3,493,923 | 2/1970 | Stevens et al. | 340/32 |
| 3,609,678 | 9/1971 | Fayling | 340/32 |
| 3,656,059 | 4/1972 | Overstreet | 340/38 L |
| 3,665,382 | 5/1972 | Siklos | 340/38 L |
| 3,714,625 | 1/1973 | Fayling | 340/32 |
| 3,753,223 | 8/1973 | Fayling | 340/32 |
| 3,787,679 | 1/1974 | Birkin et al. | 340/32 |
| 3,868,626 | 2/1975 | Masher | 340/38 L |
| 3,976,970 | 8/1976 | Tuffet et al. | 340/32 |

*Primary Examiner*—John W. Caldwell, Sr.
*Assistant Examiner*—James J. Groody
*Attorney, Agent, or Firm*—Lowe, King, Price and Becker

[57] ABSTRACT

Coded binary signals are coupled to an automotive vehicle by a magnetic signpost embedded in a traversed roadway lane. The signpost includes polarity coded magnetic pole faces having vertically directed flux lines at differing spaced longitudinal regions along the lane. Pole faces are arranged so a flux null is between adjacent longitudinal regions. Differing signals are coupled to vehicles going in opposite directions in adjacent lanes by unambiguously coding the signpost in opposite directions and arranging the pole faces so that magnetic flux continuously extends across a majority of both lanes. A detector on a vehicle includes a magnetic field concentrator including a pair of vertically extending and aligned low reluctance magnetic pole pieces having an air gap between them, in which a Hall plate is positioned. The pole piece closest to the road has shorter length than the pole piece remote from the roadway. A waveform derived by the detector includes a base line subject to drift due to ambient conditions and a pulse as the transducer crosses each region. To eliminate base line drift, a circuit with a negative feedback loop derives an analog offset signal indicative of base line drift. Fail safe circuitry prevents spurious magnetic flux variations from being recognized as a signpost by assuring that a predetermined number of bits occurs in each signpost, and that the distance between the leading and trailing edges of the same pulse and the distance between adjacent pulses are in accordance with certain distances. Valid signals are derived if a vehicle stops or backs up while over a signpost.

31 Claims, 9 Drawing Figures

VEHICULAR MAGNETIC CODED SIGNALLING APPARATUS

FIELD OF THE INVENTION

The present invention relates generally to apparatus for magnetically coupling coded signals to a vehicle and more particularly to an apparatus wherein the polarity of vertically directed magnetic flux fields are coupled to a magnetic field polarity responsive detector on a vehicle.

BACKGROUND OF THE INVENTION

Numerous systems have been proposed for coupling a magnetically coded signal to a vehicle, such as an automotive vehicle traversing a line of a roadway. These systems are characterized by signposts, each including an array of magnetic fields, generally derived from permanent magnets embedded in a roadway, in combination with a transducer mounted on the vehicle for deriving an electric signal in response to the magnetic field. The magnetic field is distributed along the roadway in a coded manner to enable the transducer to derive a multi-bit signal as it travels down a lane in which the signpost is located. The proposed prior art systems are of two categories, namely: systems responsive to a rate of change of magnetic field in response to relative movement between the vehicle and the signpost, the systems including transducers responsive to the magnitude or polarity of the magnetic field.

The former systems suffer from the inherent disadvantage of requiring movement between the vehicle and the signpost. Thereby, if the vehicle stops or moves very slowly over a signpost, the transducer is unable to derive a signal that accurately reflects the coded signal of the signpost. Also, systems of this type are subject to cumulative errors since a register must always be monitoring rate of change rather than amplitude or polarity variations.

Systems that have been proposed wherein the intensity of a magnetic field, either amplitude or polarity, in contrast to rate of magnetic field change, is coupled from a roadway to a vehicle are found in: U.S. Pat. Nos. 1,803,288; 1,803,289; 1,803,290; 1,803,291; 1,803,292, all of which are issued to Charles Adler, Jr., Lippmann et al, 3,297,866, Stevens et al 3,493,923, as well as U.K. Pat. Nos. 797,056 and 823,149. Of these proposed prior art devices, the most sophisticated and the one most suited for coupling coded signals to an automotive vehicle appears to be disclosed by the Stevens et al patent.

In the patent disclosed by Stevens, a signpost includes a single row of permanent magnets that are disposed along the length of a lane of a roadway. The magnets are polarity coded and vertically positioned so that a magnetic field amplitude or polarity detector array on a vehicle traversing the signpost is alternately responsive to polarity coded, vertically directed magnetic lines of force. The vehicle carried transducer array extends across a substantial portion of the vehicle width, i.e., in a direction transverse to the direction of travel of the vehicle. This result is achieved by providing on each vehicle several transversely spaced field concentrators, each of which includes an air gap in which is located a Hall plate. The field concentrators are mounted on a pair of magnetically permeable flux collector bars that extend substantially across the entire width of the vehicle to establish parallel magnetic field paths between the magnetic fields of the sign post and the field concentrators and Hall plates. Output signals from the several Hall plates are connected together to the input of a single amplifier which drives circuitry for analyzing the magnetic fields and for deriving an indication of the signpost data.

In the system disclosed by Stevens et al, it appears that an output signal of the detector array would be subject to error if the vehicle is not driving exactly straight on the roadway, i.e., the vehicle is skewed. This is because the multiple Hall plates in the Stevens et al arrangement are possibly subjected to relatively strong magnetic fields at differing portions of the road. Hence, there is a possibility that the magnetic field from a signpost could interact with the magnetic field from some other object in the roadway as the vehicle traverses the roadway. The two interacting magnetic fields could nullify each other so that there is an unpredictable variation in the magnetic field coupled to the Hall plates, depending upon the skew angle of the vehicle. Also, because of the parallel low reluctance paths through the several field concentrators to a plurality of Hall plates, the field traversing each Hall plate is reduced. Hence, there is a tendency for the sensitivity of an array of the type disclosed by Stevens et al to be less than the sensitivity of an array including a single field concentrator and a single Hall plate. Of course, it is desirable to employ a magnetic field amplitude or polarity detector employing a single Hall plate and concentrator because of the cost involved in installing several Hall plates and concentrators on many thousands of vehicles which might be involved in a system for coupling signpost information from a roadway to a vehicle.

Another defect in the prior art magnetic field amplitude or polarity systems is that they fail to take into account the inherent drift of a magnetic field amplitude or polarity transducer as a function of ambient temperature and magnetic field. In experiments that we have conducted, it was determined that ambient changes in magnetic field and temperature cause a base line drift frequently of the same order of magnitude as the magnetic field variations associated with a signpost. Conventional automatic gain control systems did not function adequately because of the extremely long term nature of the ambient variations, as well as because of the necessity to deactivate the automatic gain circuit while a signpost is being detected.

There are other problems which prior art workers have apparently failed to appreciate. In particular, the prior art systems are subject to erroneous results because they do not check to assure that a correct number of pulses are coupled to the vehicle magnetic field transducer from each signpost, and because they do not establish criteria for the spatial distance between the leading and trailing edges of each pulse, or between the trailing and leading edges of adjacent pulses, as a function of possible skew. In experiments we have conducted we have found that the presence of magnetic field anamolies along the length of a roadway can appear as a signpost if precautions are not made to distinguish these anomalies from signpost field variations.

The prior art has also apparently failed to consider the consequences of a vehicle stopping over a signpost and then backing up while over the signpost, either to a position within the sign post or outside of the sign post. If precautions are not taken to compensate for errors due to stopping and backing up over a signpost, erroneous results will occur.

It is, accordingly, an object of the present invention to provide a new and improved apparatus for coupling magnetically coded information from a signpost to a vehicle.

Another object of the invention is to provide a new and improved apparatus for coupling magnetically coded polarity information from a magnetic signpost to a vehicle transversing the signpost.

A further object of the invention is to provide a new and improved magnetic signpost and vehicular detector arrangement that is relatively inexpensive, highly sensitive, and is capable of accurately detecting signpost information even if the vehicle is skewed with respect to a lane including a signpost.

An additional object of the invention is to provide a new and improved apparatus for magnetically coupling signpost signals to a vehicle wherein long term ambient conditions, such as temperature and magnetic field, that would affect the output of a magnetic field polarity sensor are compensated.

A further object of the invention is to provide a new and improved magnetic field amplitude signpost for coupling magnetically polarized data to a vehicle including a magnetic field polarity transducer.

A further object of the invention is to provide a new and improved system for coupling magnetic field signpost information to a vehicle wherein processing circuitry is provided to minimize or eliminate errors due to magnetic field anomalies along a roadway being traversed by the vehicle.

Another object of the invention is to provide a new and improved system for coupling magnetic field polarity information from a signpost to a vehicle wherein pulses detected by a magnetic field polarity detector on the vehicle are processed as a function of width between leading and trailing edges within the pulse and between adjacent pulses, as a function of distance traveled by the vehicle, to substantially prevent magnetic anomalies in the roadway from being indicated as a signpost.

Yet another object of the invention is to provide a new and improved system for coupling coded signals from a magnetic signpost to a vehicle wherein accurate signpost information is derived even though the vehicle stops and backs up over a signpost.

BRIEF DESCRIPTION OF THE INVENTION

In accordance with one aspect of the invention, polarity coded magnetic signals are coupled from a signpost to a vehicle traversing a lane in which the signpost is located by providing the signpost with a plurality of polarity coded magnetic pole faces at differing spaced longitudinal regions along the lane. The pole faces at the spaced longitudinal regions are arranged so that there is substantially a magnetic flux null between each adjacent pair of the spaced longitudinal regions. A single magnetic flux amplitude transducer, e.g., a Hall plate, mounted on the vehicle derives distinct opposite polarity pulses for each region crossed by the vehicle. The pole faces are arranged so that at each of the spaced longitudinal regions there is a substantial amount of magnetic flux having vertically directed magnetic flux lines of a single polarity continuously across at least a majority of the lane. The transducer has an effective length in the direction of vehicle travel much less than the distance between any adjacent pair of the longitudinal regions and an effective length in the direction transverse to the direction of travel much less than the length of the flux across the lane, so that the transducer responds to the magnetic flux from only a single one of the longitudinal regions. Such an arrangement enables the array and transducer of the present invention to have increased sensitivity over the prior art arrangements, as well as greater accuracy because the transducer output signal is not affected by magnetic anomalies to the side of the signpost.

According to a feature of the present invention, the signposts are direction coded, a result achieved by arranging the pole faces to be asymmetrical at each signpost, i.e., the sequence of magnetic field polarities for the signposts for the lane going in a first direction differ from those for the lane going in the second direction. There is a substantial amount of magnetic flux of the same polarity continuously across at least a majority of each of the oppositely directed lanes at the same spaced longitudinal regions of the lanes. For roadways that have opposite lanes either abutting or in close proximity to each other, the pole faces are arranged so that at the same spaced longitudinal regions of both lanes there is a substantial amount of magnetic flux of the same polarity continuously across both of the lanes.

In accordance with another aspect of the invention, the transducer output is compensated for long term base line variations, i.e., drift, due to changes of ambient conditions, such as temperature and magnetic field. The transducer output is converted into a waveform including bipolarity pulses relative to a substantially constant base line by eliminating the base line drift. The polarity of the pulses in the waveform is indicative of the polarity of the lines of flux at each of the regions in the signpost. The base line drift is eliminated with circuit means including negative feedback means responsive to an output signal of the transducer for deriving an analog offset signal indicative of the base line drift. The feedback means includes means for combining the offset signal with the transducer output waveform to derive an error signal that is converted into the substantially constant base line waveform. The feedback means also includes a feedback path responsive to the error signal for controlling the offset signal. Control of the offset signal by the feedback path is disabled so that the offset signal is maintained constant while the transducer is over a signpost. In a preferred embodiment, the feedback path includes a bidirectional counter responsive to the bidirectional waveform and a source of control pulses which, together, drive the counter in opposite directions in response to pulses of the first and second polarities occurring in the bidirectional waveform. To derive the offset signal, the output of the counter is converted into an analog signal that is combined with the transducer output signal.

As a further feature, digital processing circuitry is responsive to the bidirectional, constant base line signal to derive a signal that is an accurate indication of a magnetic signpost, whereby magnetic anomalies in the roadway are not recognized as a signpost. In particular, the vehicle is provided with an odometer that derives an output pulse for the vehicle traversing a predetermined distance. The odometer output pulses are combined with signals indicative of the occurrence times of leading and trailing edges of pulses in the bidirectional waveform, and thereby indicative of the spatial position of leading and trailing edges of magnetic fluxes having amplitudes on the order of the fluxes associated with a signpost. The odometer and leading and trailing edge signals are combined to assure that each bidirectional pulse has a predetermined width, as a function of vehicle spatial position, as well as to assure that there is a predetermined spatial separation between adjacent pulses. The spatial separation between adjacent pulses can extend over a predetermined distance window to provide for skew between the vehicle and the signpost. If the vehicle traverses an excessive distance in accumulating a predetermined number of pulses, associated with a signpost, an indication is provided that the vehicle has not actually been traversing a signpost.

As a further feature, apparatus is provided to enable an accurate indication of a signpost to be derived even if the vehicle stops over a signpost and backs up while over the signpost. If the vehicle backs up partially over the signpost and resumes forward travel, a register is responsive to binary signals indicative of the polarity of the magnetic flux in the signpost at the regions traversed after the initial stop. In contrast, if the vehicle backs completely out of the signpost, the register is responsive to a new sequence of binary pulses as the vehicle again crosses over the signpost.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWING

Figure 1:
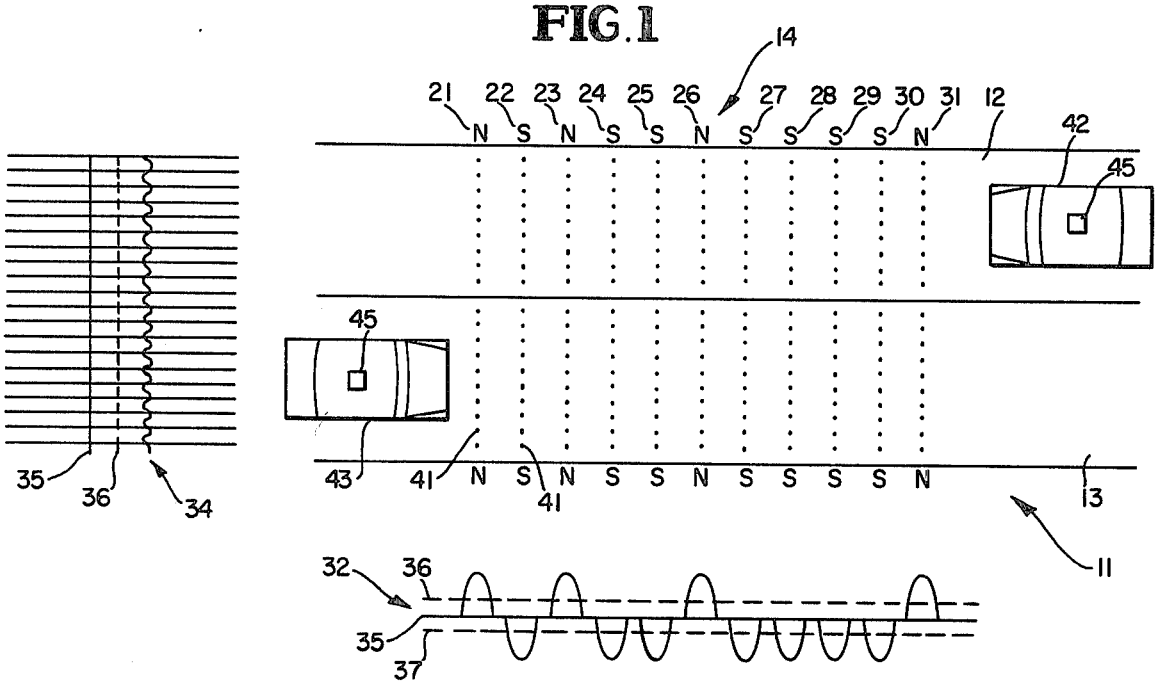
FIG. 1 is a view illustrating a roadway with oppositely directed lanes including a signpost in accordance with the present invention, as well as magnetic flux variations in differing directions of the signpost.

Reference is now made to FIG. 1 of the drawing wherein there is illustrated a roadway 11 including a pair of abutting lanes 12 and 13 for traffic going in opposite directions. Roadway 11 includes a magnetic signpost 14 containing a plurality of longitudinally spaced regions 21-32 that are polarity coded to derive vertically directed, static magnetic lines of flux containing binary coded information. In one preferred embodiment, an 11-bit binary magnetic flux field occurs at each signpost 11 and is indicative of the signpost location; it is to be understood, however, that the signpost may contain any appropriate number of bits and can be indicative of other information, as desired.

The spacing between adjacent longitudinal regions of signpost 14, for example the distance between longitudinal regions 25 and 26, is such that there is a substantial null in the magnetic field between the adjacent regions. The magnetic field along the length of signpost 14 is indicated by the undulations of waveform 32 which are aligned with the longitudinal regions 21-31 to represent the polarity variations of the signpost 14. Each undulation of waveform 32 drops to a zero, i.e., baseline, value 35, as well as below positive and negative threshold levels 36 and 37. For the exemplary signpost 14 the magnetic polarity variations are indicative, from left to right, of the binary signal 10100100001, wherein north and south vertically directed magnetic fields are respectively assumed to be represented by the binary values 1 and 0.

At each of the longitudinal regions 21-31 there is a substantial, continuous magnetic field of the same polarity across at least a majority of each of lanes 12 and 13, and preferably across the entire lane. The magnetic field at each longitudinal position is of the same polarity for both of lanes 12 and 13 to minimize any effects of cross-coupling from one lane to another. The magnetic flux variations across the width of roadway 11 at longitudinal region 21 is represented by the undulations of waveform 34. It is noted that the undulations of waveform 34 always remain considerably above zero baseline 35, as well as a threshold detection value 36.

To enable signpost 14 to be unambiguously coded for two lanes 12 and 13 and enable the code to uniquely identify the signpost location and the direction of travel of a vehicle over it, the flux patterns in regions 21-31 are asymmetrically arranged. Thereby, the sequence of binary 1's and 0's for lanes 12 and 13 always differ from each other for vehicles going over the signpost in the two lanes in opposite directions, whereby the binary sequence for lane 14 is as indicated supra, but the sequence for lane 13 is 10000100101.

Preferably, the magnetic field variations indicated by waveforms 32 and 34 are established by signpost 14 by embedding a matrix of permanent magnets 41 in roadway 11 at the time the roadway is constructed. Permanent magnets 41 are embedded vertically into lanes 12 and 13 so that a north pole face or south pole face of each magnet is in closest proximity to the roadway surface, while the opposite pole of the magnet is remote from the roadway surface. At each of longitudinal positions 21-31, each of the permanent magnets 41 is embedded in roadway 11 such that all of the magnets have like polarity, whereby at longitudinal position 21 each of the permanent magnets 41 has its north pole face closest to the surface of roadway 11, while at longitudinal position 22 each of the permanent magnets 41 is arranged so that its south pole face is in closest proximity to the roadway surface.

The spacing of permanent magnets 41 enables the null effect of waveform 32 and the continuous flux pattern of waveform 34 to be derived. In one particular embodiment, there is a center line separation of 21 inches between each of the longitudinal regions 21-31 and a transverse center line separation of 8 inches between adjacent magnets in each of the regions 21-31. Hence, for a typical roadway including two abutting ten-foot lanes there are 27 permanent magnets at each of the longitudinal positions 21-31 or a total of 297 permanent magnets in each of signposts 14. Of course, the number of permanent magnets can be reduced if it is desired for the continuous magnetic field to extend only slightly over half of the width of each lane. Also, if lanes 12 and 13 are not in abutting relationship, but are separated from each other, the magnetic fields of both lanes of the roadway need not be continuous with each other. However, it is preferable, in order to avoid any possibility of interference between the magnetic fields at the same longitudinal position, for the magnetic field polarity at each longitudinal position of a signpost to be the same.

The polarity variations of signpost 14, as indicated by the undulations of waveform 32, are detected by a single magnetic field responsive transducer fixedly mounted in each of automotive vehicles 42 and 43 that respectively traverse lanes 12 and 13 from right to left and left to right. Transducers 45 respond to the magnetic field amplitudes of signpost 14, rather than the rate of change of movement of the transducer with respect to the signpost, whereby transducers 45 on vehicles 42 and 43 derive time and position dependent output waveforms that are replicas of waveform 32 from right to left and left to right as the vehicles traverse the signpost at constant speed. If vehicles 42 and 43 traverse signpost 14 with variable velocity, or even stop while over the signpost, waveform 32 represents the distant dependent outputs of transducers.

Transducers 45 are positioned on vehicles 42 and 43 in close proximity to the surface of roadway 11, and approximately at the centroid of each of the vehicles. Transducers 45 are preferably remotely located from the very hot parts of vehicles 42 and 43, such as the engines and radiators thereof, to minimize the effects of ambient temperature on the transducer output. It is advantageous to position the transducers 45 approximately at the centroid of the vehicle so that the usually ferrous, metal exterior of the vehicle can act as a shield to minimize the effects of magnetic fields outside of the perimeter of the vehicle on the transducers.

The effective length of transducer 45 in the direction of travel of vehicle 42 is much less than the distance between any adjacent pair of longitudinal regions 21-31. Similarly, the effective distance of transducer 45 in the direction transverse to the direction of travel of vehicle 42 is much less than the length of the magnetic flux pattern across each of lanes 12 and 13 at each of the longitudinal positions. The single transducer 45 on each of the vehicles is thereby responsive to the magnetic field from only one of the longitudinal regions at a time, even if the vehicle in which the transducer has a skewed path with respect to the longitudinal regions, i.e., the vehicle crosses the longitudinal regions at other than a right angle. In one particular embodiment, transducer 45 has a square cross section with equal effective lengths in the direction of travel and at right angles to the direction of travel of the vehicle in which it is mounted of one inch.

Figure 2:
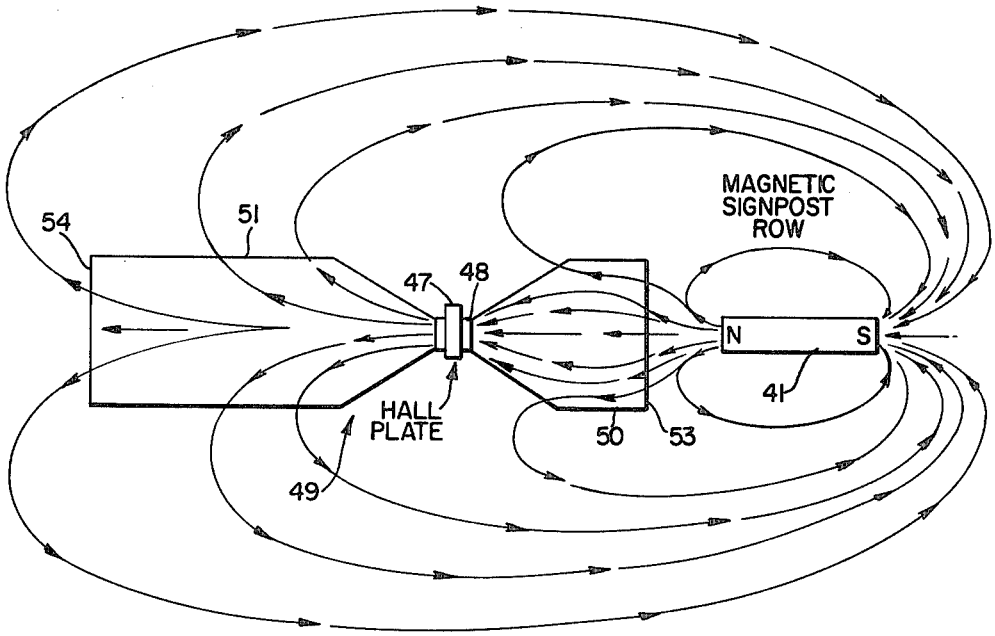
FIG. 2 is a schematic representation of a flux transducer of the type employed in a vehicle using the system of the present invention.

To convert the magnetic fields of signpost 14 into an electrical signal having a polarity that is a replica of the magnetic fields at regions 21-31 as vehicle 42 traverses the signpost 14, either while the vehicle is moving or standing still, transducer 45 includes a Hall plate 47, as schematically illustrated in FIG. 2. A typical Hall plate has an extremely small magnetic field capture area, on the order of 0.2 square inches and derives a very low power output signal. To increase the capture area of Hall plate 47 and enable it to derive a higher output signal, the Hall plate is inserted in air gap 48 of a magnetic concentrator 49 including vertically aligned magnetic pole pieces 50 and 51. Pole pieces 50 and 51 are tapered toward air gap 48 so that there is a greater magnetic flux concentration in the air gap than at equal area pole piece faces 53 and 54 which extend in the horizontal direction and are remote from the air gap. Thereby, magnetic lines of flux between the pole faces of permanent magnet 41 flow via a low reluctance path through pole piece 50 and are concentrated through air gap 48 and into Hall plate 47. From Hall plate 47 the lines of flux proceed through the remainder of air gap 48 into and out of pole piece 51 back to the pole face of permanent magnet 41 that is remote from the surface of roadway 13. Since virtually all of the magnetic flux that flows through pole face 53 flows through the high magnetic permeability path of pole piece 50 to Hall plate 47 and the Hall plate sits in an air gap having an area considerably less than the area of face 53, the magnetic field concentration in the Hall plate is considerably greater than at face 53 so that there is a relatively large magnetic field coupled to the Hall plate.

Pole piece 50 has a shorter height than pole piece 51 because the magnetic lines of flux close to the upper pole face of magnet 41 are straighter than the fringing field lines of flux at distances remote from the magnet. Longer, upper pole piece 51 has a tendency to straighten the fringing field magnetic lines of flux that leak back to the lower pole of permanent magnet 41, whereby the magnetic lines of flux that traverse Hall plate 47 remain at a right angle as they traverse the Hall plate to maximize the Hall plate output signal. In a typical embodiment, pole face 53 has an area of one square inch, while the faces of pole pieces 50 and 51 abutting air gap 48 have an area approximately one-sixth that of pole face 53.

The output signal derived by Hall plate 47 is susceptible to long term drift, as a function of ambient magnetic field and temperature. It has been found that the drift in many cases is equal in amplitude to the amplitude of signpost signals derived from Hall plate 47. Because of the desirability of providing a DC path between the Hall plate and detection circuitry for the sensed magnetic field signpost polarity, it is necessary to provide long-term offset for the output of Hall plate 47.

To these ends, the output of Hall plate 47, which is energized by DC source 55, is DC-coupled to differential input terminals 56 of DC pre-amplifier 57. Pre-amplifier 57 derives an output signal that is DC-coupled to inverting input terminal 58 of DC differential amplifier 59. Non-inverting input terminal 60 of amplifier 59 that is part of an offset deriving feedback means and is responsive to an offset signal that compensates for the ambient related base line variations in the output of pre-amplifier 57. Amplifier 59 combines the output signal of pre-amplifier 57, and the offset signal applied to terminal 60 to derive an error signal that is reflected in the output of amplifier 59 as a waveform having a substantially constant base line. To prevent magnetic flux variations of signpost 14 from affecting the offset voltage applied to terminal 60, the offset signal is not subject to change while the vehicle in which Hall plate is mounted is over a signpost. The constant base line output of amplifier 59 is applied in parallel to two sets 62 and 63 of threshold detectors. Detectors 64 and 65 in set 62 are set to thresholds indicated by lines 36 and 37, FIG. 1, appreciably above the base line output of amplifier 59, so that many of the spurious magnetic field variations which occur along roadway 11 and are not associated with signpost 14 are not reflected in the outputs of detectors 64 and 65. Thereby, detectors 64 and 65 respectively derive binary one output signals in response to the absolute value of the magnetic field transduced by Hall detector 47 exceeding the levels associated with lines 36 and 37.

The binary one output signals of threshold detectors 64 and 65 are combined in OR gate 66, which derives an output signal that is applied to the set input terminal of flip-flop 67. The leading edge of the output signal of OR gate 66, which occurs in response to the vehicle traversing the first longitudinal region 21 or 31 of signpost 14, causes flip-flop 67 to be activated into the set state. Subsequent occurrences of the output signal of OR gate 66 as the vehicle is traversing signpost 14 generally have no effect on flip-flop 67. Hence, the leading edge of the Q output of flip-flop 67 can be considered as a start signpost signal. Flip-flop 67 remains in the set state until a signal is applied to its reset input. The reset signal for flip-flop 67 is derived, as described infra, in response to indications being derived that the vehicle has completely traversed the signpost, or that the output signal of OR gate 66 was not actually derived in response to a magnetic field from a signpost, but in response to a spurious magnetic field.

Flip-flop 67 includes a complementary $\overline{Q}$ output signal having a binary one level except while flip-flop 67 is in the set state, i.e., $\overline{Q}=1$ except generally while the vehicle is traversing a signpost. The $\overline{Q}$ output of flip-flop 67 enables AND gate 68 which is responsive to a relatively low frequency clock source 69; typically, source 69 has a frequency on the order of 2 Hertz. AND gate 68 passes the leading edge of pulses derived from clock source 69 to network 71 that controls the offset level applied to terminal 60.

Network 71 includes threshold detectors 72 and 73, which form a part of set 63. The threshold levels of detectors 72 and 73 are set slightly above and below the desired base line level for the output of amplifier 59 and appreciably below the threshold levels of detectors 64 and 65; e.g., 5% of threshold levels 36 and 37. Thereby, in response to the output of amplifier 59 increasing slightly above or below the base line level, detectors 72 and 73 respectively derive binary one output signals. The binary one output signals of threshold detectors 72 and 73 are applied through AND gates 74 and 75 to increment and decrement input terminals of reversible counter 76. AND gates 74 and 75 are selectively enabled in response to the output of AND gate 68 so that the count stored in counter 76 can be adjusted only while the vehicle is not travering a signpost.

In response to the control signals applied by gates 74 and 75 to the increment and decrement input terminals of counter 76, the counter stores a binary level associated with the offset necessary to restore the base line of the input signal to terminal 58 of amplifier 59 to the desired base line at the output of the amplifier. To enable the offset signal to be continuously derived, the state of counter 76 is continuously monitored by coupling parallel outputs of the counter to the input of digital-to-analog converter 77. Converter 77 responds to the output signal of counter 76 to derive a DC analog signal that is DC-coupled to terminal 60 and is equal to the base line drift at the output of amplifier 57. Thereby, circuit 71 forms a negative feedback path for deriving an analog signal indicative of the base line drift.

Because of the high probability of magnetic irregularities affecting the signal derived from transducer 45, numerous checks are made to ensure that a signpost is actually detected and encoded. The checks involve determining if: (1) the spatial distance between the leading and trailing edges of each signpost pulse is greater than a predetermined distance and whether the spacing between the trailing and leading edges of adjacent pulses exceeds this predetermined distance; (2) the distance between the leading edges of adjacent pulses falls within a spatial window having a minimum distance equal to the distance between the beginning of each longitudinal region of a signpost and a maximum distance equal to the greatest straight line skewed distance between the leading edge of each signpost longitudinal region; and (3) eleven signpost pulses are detected within a predetermined distance window, having a minimum length equal to the distance from beginning to the end of the signpost and a maximum distance equal to the maximum distance of a skewed path for the vehicle over the entire signpost. Activation of the various circuits for performing these checks is complicated since the vehicle may stop and back up while over a signpost. Circuitry is also provided to enable a signpost to be accurately read even though a vehicle stops over a signpost and backs up partially within the signpost or fully to a region outside of the signpost. If it is determined that a signpost has been in fact detected by transducer 45, the vehicle includes equipment for enabling the signpost indication to be transmitted to a remote location in response to a command signal derived either at the vehicle or the remote location.

Figure 3:
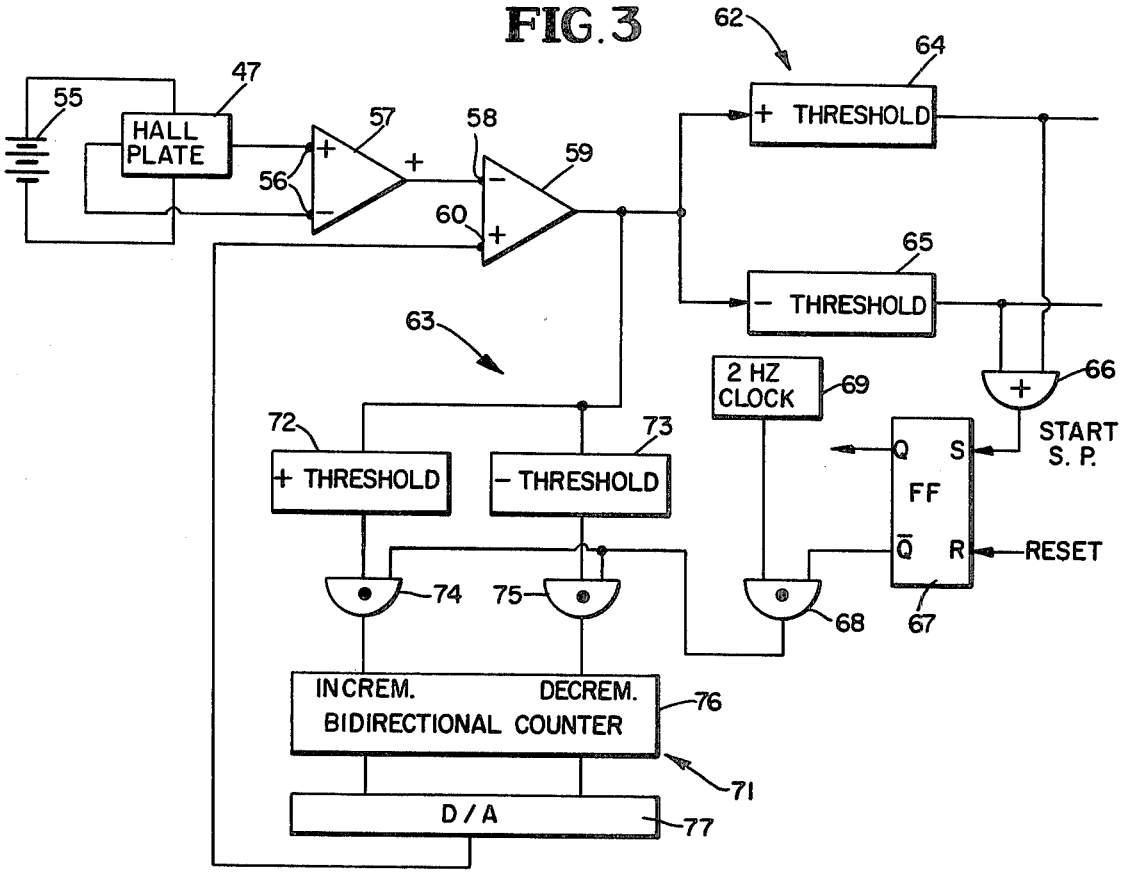
FIG. 3 is a block diagram of detector circuitry incorporated with the present invention.
Figure 4:
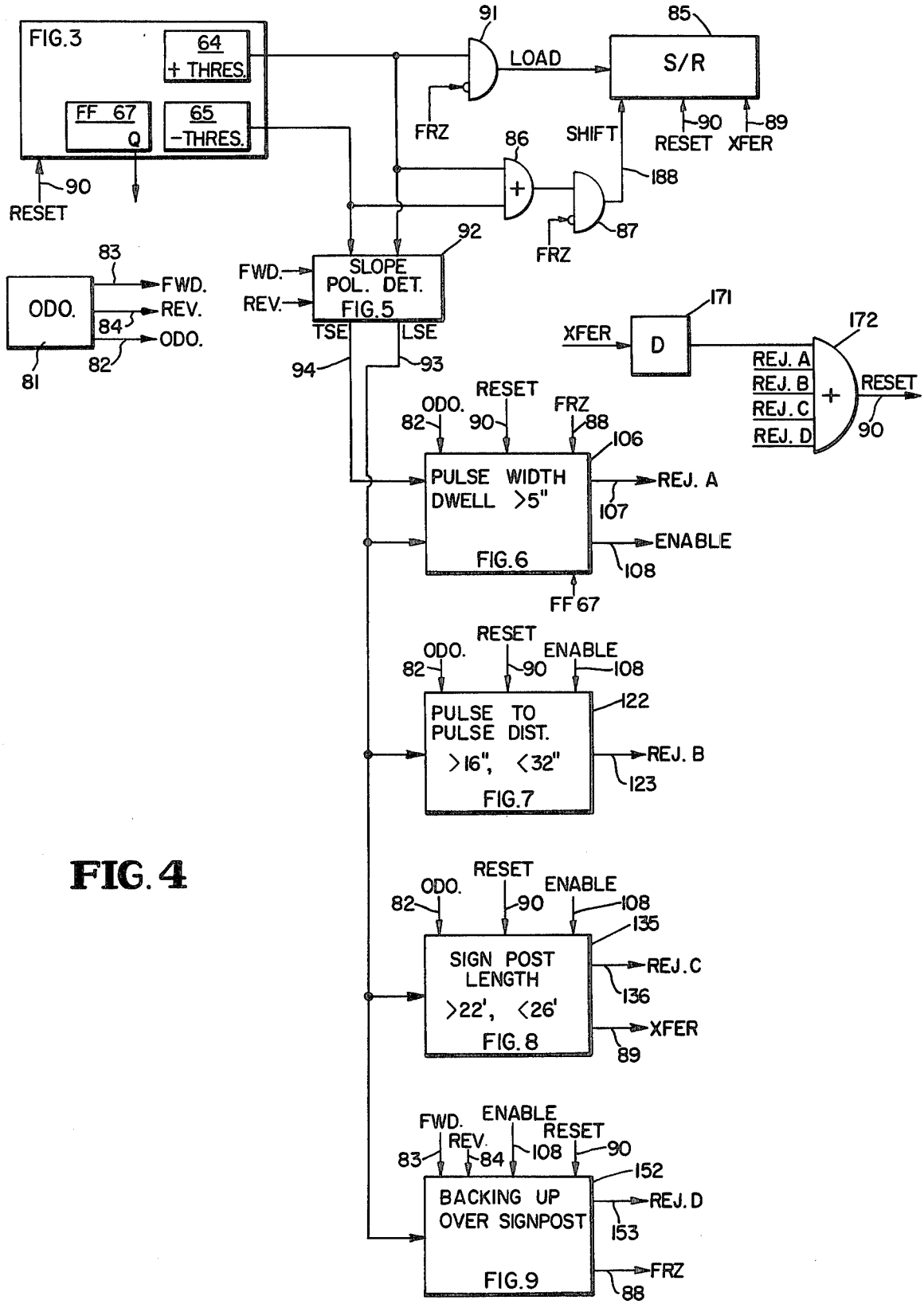
FIG. 4 is an overall block diagram of one embodiment of the date processing system utilized with the present invention.

A block diagram of apparatus carried on the vehicle to enable the various described checks to be performed and the bits of a correctly detected signpost to be supplied to a radio transmitter on the vehicle is illustrated in FIG. 4. The digital circuitry described in connection with FIG. 4 is always responsive only to positive pulses, unless otherwise indicated. The system illustrated in FIG. 4 is responsive to the binary one levels selectively derived from threshold detectors 64 and 65, FIG. 3, as well as the binary output signal at the Q terminal of flip-flop 67. In addition, the system of FIG. 4 is responsive to a distance indicating signals derived from odometer 81 that is carried by each vehicle including the equipment of the present invention. Odometer 81 derives a pulse-type output (ODO) on lead 82, such that one occurs in response to the vehicle traversing a predetermined distance, such as one inch. In addition, odometer 81 includes a pair of binary output signal leads 83 and 84 on which are derived binary one levels (FWD and REV) in response to the vehicle respectively moving in the forward and reverse directions.

The binary ones derived by threshold detector 64 and 65 cause shift register 85 to be loaded with a binary signal indicative of the magnetic polarities detected by transducer 45. Binary ones derived from threshold detector 64 are normally applied through inhibit gate 91 to a load input of shift register 85, having a shift input normally responsive to the occurrence of each binary one output of threshold detectors 64 and 65, as combined in OR gate 86 that normally drives the shift input of shift register 85 through inhibit gate 87. Inhibit gates 87 and 91 respectively block the output pulses of OR gate 86 and detector 64 only while the vehicle transducer 45 is backing up over a signpost, which results in freeze signal (FRZ) being derived on lead 88, as described infra. Shift register 85 is also responsive to a transfer signal (XFER) which is derived on lead 89 whenever it has been determined that transducer has completely traversed a signpost, as described infra. XFER causes the binary bits loaded in shift register 85 to be read out to a register in the transmitter. Shift register 85 is also responsive to a reset signal (RESET) on lead 90, which signal is derived in response to a determination that the binary levels derived from detectors 64 and 65 are not associated with a signpost or upon a recognition of the vehicle backing completely out of a signpost. A reset signal is also applied to lead 90 shortly after the contents of shift register 85 have been transferred in response to the signal on lead 89.

Figure 5:
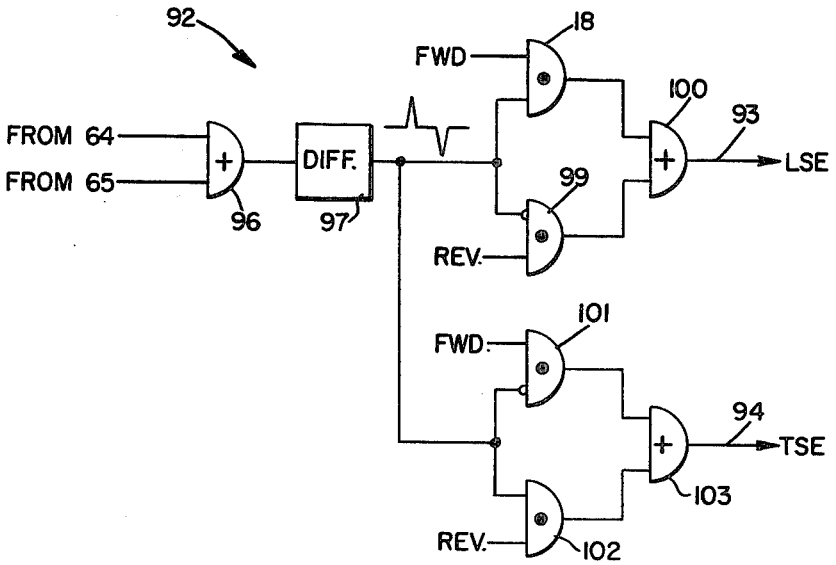
FIG. 5 is a block diagram of a slope polarity detector employed in the system of FIG. 4.

To these ends, the system illustrated in FIG. 4 includes a slope polarity detector, illustrated in detail in FIG. 5, responsive to the binary output signals of detectors 64 and 65, as well as the FWD and REV signals on leads 83 and 84. Slope polarity detector 92 responds to these signals to derive pulse signals on leads 93 and 94 (LSE & TSE) that respectively occur in response to transducer 45 passing over the leading and trailing spatial edges of a signpost longitudinal region. Hence, referring to FIG. 1, as vehicle 43 traverses the signpost in the forward direction (from left to right) a pulse is derived on lead 93 as transducer 45 crosses the leading, i.e., left edge of longitudinal region 21; a pulse is derived on lead 94 as transducer 45 traverses the trailing, i.e., right, edge of longitudinal region 21. If vehicle 43 stops while over signpost 14, so that transducer 45 is between longitudinal regions 21 and 22, a pulse is derived on lead 94 when the vehicle begins to back over the trailing, i.e., right, edge of longitudinal region 21 and a pulse is thereafter derived on lead 93 as the transducer moves to the left, past the leading, i.e., left, spatial edge of region 21. Hence, regardless of the direction of travel of vehicle 43 over a particular longitudinal region of signpost 14, pulses are derived on leads 93 and 94 on a spatial, rather than time, basis.

One embodiment of apparatus for implementing the slope polarity detector 92 is illustrated in FIG. 5 of the drawing wherein the binary one output signals from detectors 64 and 65 are applied to OR gate 96, the output of which drives differentiator 97. Differentiator 97 derives positive and negative pulses in response to the leading and trailing edges of each binary one level derived from either of detectors 64 or 65. To derive the leading spatial edge pulses, the output of differentiator 97 is combined with the FWD signal on lead 83 in AND gate 98. In addition, the output of differentiator 97 is inverted and combined with the REV signal on lead 84 in AND gate 99. AND gates 98 and 99 derive binary one signals in response to both inputs thereof having binary one levels, whereby pulses are derived by the AND gates in response to transducer 45 passing over the leading spatial edge of any of regions 21–31, regardless of the direction of travel of vehicle 43. The output signals of AND gates 98 and 99 are combined in OR gate 100 to derive the LSE signal on lead 93. Similarly, inverted and uninverted replicas of the output of differentiator 97 are respectively combined with the FWD and RVE signals in AND gates 101 and 102, the outputs of which are combined in OR gate 103 to derive the TSE signal on lead 94.

To assure that the leading and trailing edges of each pulse transduced by transducer 45 are separated from each other by a predetermined distance and to assure that the distance between the leading and trailing edges of adjacent pulses are separated from each other by the same predetermined distance (assumed to be five inches in one particular embodiment), the LSE and TSE output signals of slope polarity detector 92 are combined with the ODO signal on lead 82 in pulse width/dwell circuit 106. Circuit 106 is also responsive to the FRZ and RESET signals on leads 88 and 90, as well as the Q output of flip-flop 67. Circuit 106 responds to its input to derive a REJ A signal on lead 107, the derivation of which indicates that there is an inadequate distance between the leading and trailing edges of the same transduced pulse or an inadequate distance between the trailing and leading edges of adjacent transduced pulses. Circuit 106 also derives an ENABLE signal on lead 108 in response to the vehicle being stationary or moving in a forward direction over a signpost.

Figure 6:
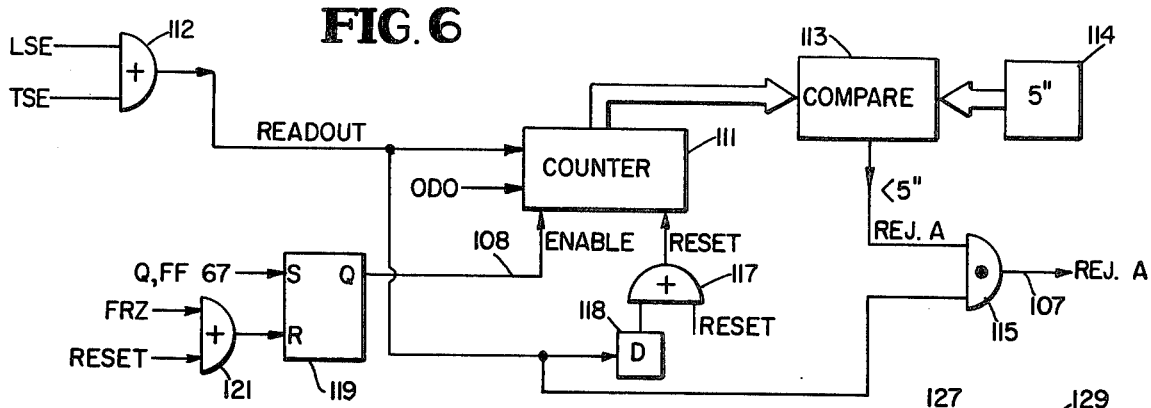
FIG. 6 is a block diagram of a pulse width/dwell circuit employed in the system of FIG. 4.

To these ends, circuit 106 includes circuitry as illustrated in FIG. 6. Circuit 106 includes counter 111 having a count input responsive to the ODO pulses on lead 82. The count stored in counter 111 is read out each time an LSE or TSE signal is derived on lead 93 or 94, by applying the LSE and TSE signals to OR gate 112, which drives a readout command input terminal of counter 111. The output signal of counter 111 is compared in comparator 113 with a predetermined signal stored in register 114, which is indicative of a count associated with five inches. In response to the output signal of counter 111 being less than the five-inch signal stored in register 114, comparator 113 derives a binary one signal. To sssure that the output of comparator 113 is examined only while the contents of counter 111 are being read out, the output of the comparator is combined in AND gate 115 with the output of OR gate 112. AND gate 115 derives on lead 107 a REJ A signal to provide an indication that the transduced signals which caused derivation of the TSE and LSE signals were due to a magnetic flux variation other than a signpost magnetic flux.

Counter 111 is reset in response to the RESET signal on lead 90 or in response to the counter being read out. To this end, the reset signal on lead 90 is applied to a reset input of counter 111 via OR gate 117 that is also responsive to the output of OR gate 112, as coupled through delay network 118. Delay network 118 has a short delay time adequate to enable the contents of counter 111 to be read out and compared in comparator 113 prior to resetting of the counter.

Counter 111 is enabled so it can be responsive to ODO pulses and to be read out only while transducer 45 is traversing signpost 14 in the forward direction or while the transducer is stationary over the signpost. To this end, counter 111 includes an enable input terminal responsive to the principal (Q) output of flip-flop 119, having a set input responsive to the leading edge of the output of flip-flop 67, FIG. 3. Flip-flop 119 includes a reset input that is responsive to the reset signal on lead 90 or the FRZ signal on lead 88, which signals are combined in OR gate 21 and applied to the reset input of flip-flop 119. Flip-flop 119 responds to the signals applied to its set and reset input terminals to derive the ENABLE signal on lead 108 at its Q output only while transducer 45 is moving forward or is stationary over signpost 14.

In order to be a signpost, the spacing between adjacent leading spatial edges must fall within a predetermined spatial window. While the permanent magnets of adjacent longitudinal spaced regions 21–31 are spaced from each other by 21 inches, the leading spatial edges of the adjacent areas may be as close to each other as 16 inches because of different fringing field effects and other magnetic anomalies along the length of a signpost. The maximum distance traversed by transducer 45 is passing between the leading spatial edges of adjacent signposts may be as great as 32 inches because of the possibility of a skewed path existing between the transducer and the adjacent longitudinal signpost regions. Hence, it is necessary to determine if adjacent LSE pulses occur within a window of between 16 inches and 32 inches. To this end, there is provided circuit 122 that is responsive to the LSE pulses on lead 93, as well as the ODO pulses on lead 82, the reset signal on lead 90 and the ENABLE signal on lead 108. In response to adjacent LSE pulses having a separation less than 16 inches or greater than 32 inches, circuit 122 derives a REJ B signal on lead 123.

Figure 7:
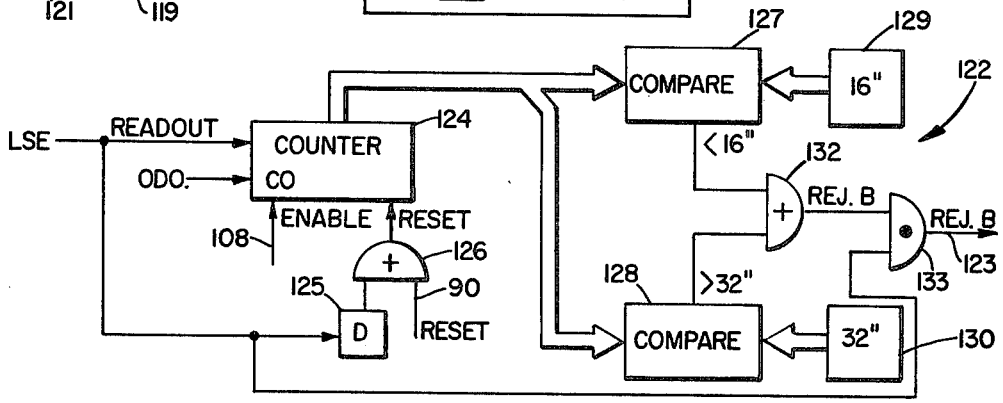
FIG. 7 is a block diagram of a pulse to pulse distance measuring circuit employed in the system of FIG. 4.

In FIG. 7, there is illustrated one embodiment of apparatus for implementing circuit 122. Circuit 122 includes counter 124 having a count input terminal responsive to the ODO pulses on lead 82, as well as a readout control input terminal responsive to the LSE pulses. Counter 124 is enabled while transducer 45 is either stationary or moving in the forward direction over signpost 14, in response to the ENABLE signal on lead 108. Counter 124 is reset to 0 in response to the reset signal on lead 90 or slightly after the contents thereof have been read out. To this end, the signal on lead 90 and the LSE signal, after having been coupled through delay element 125, are combined in OR gate 126, having an output which drives a reset input of counter 124.

The output of counter 124 is compared in comparators 127 and 128 with signals stored in registers 129 and 130, respectively commensurate with signals representing travel distances of 16 inches and 32 inches. Comparators 127 and 128 respond to their input terminals to derive binary one signals in response to their inputs being respectively less than and greater than the values stored in registers 129 and 130. The output signals of comparators 127 and 128 are combined in OR gate 132, the output of which is coupled through AND gate 133 when the AND gate is enabled by the LSE pulse. Thereby, AND gate 133 derives the REJ B signal on lead 123.

A further test to determine if a signpost is actually being traversed is to ascertain if the predetermined number of bits associated with a signpost has been traversed after transducer 45 has moved forward a predetermined distance. For the 11-bit, 21-inch separation situation, the 11 bits must be derived over a distance of at least 22 feet. Because of skew, the maximum distance over which the 11 bits can be derived is 26 feet. Hence, if eleven bits are derived in less than 22 feet or more than 26 feet, those bits are not recognized as a signpost. Circuit 135 responds to the LSE pulses on lead 93, the ODO pulses on lead 82, the reset signal on lead 90, and the ENABLE signal on lead 108 to derive a REJ C signal on lead 136 or a XFER signal on lead 89. The REJ C signal is derived on lead 136 if it is found that the eleven pulses are not derived within the 22-foot to 26-foot window. If, however, eleven LSE pulses are derived during this window, a binary one level is derived on XFER lead 89.

Figure 8:
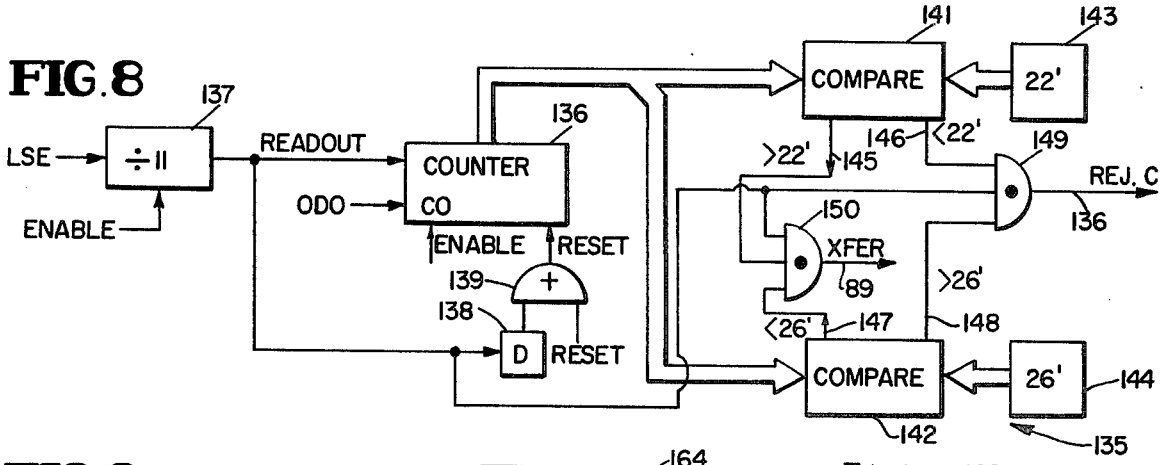
FIG. 8 is a block diagram of a signpost length detector employed in the system of FIG. 4.

In FIG. 8 there is illustrated a block diagram of circuit 135. Circuit 135 includes counter 136 having a count input responsive to the ODO pulses on lead 82, as well as a readout input terminal responsive to the LSE pulses on lead 93, after these pulses have been selectively frequency divided in counter 137 by a factor equal to the number of binary bits in a signpost; in the present example, the frequency division factor equals 11. Frequency divider 137 includes an enable input terminal responsive to the ENABLE signal on lead 108 so that divider 137 is responsive only to LSE signals while the vehicle is moving over signpost 14 in the forward direction. Counter 136 also includes an enable input terminal responsive to the ENABLE signal on lead 108, as well as a reset input terminal which is responsive to the output signal of frequency divider 137 and the RESET signal on lead 90. The output signal of frequency divider 137 is delayed in network 138, the output of which is combined with the reset signal on lead 90 in OR gate 139, the output of which is applied to the reset input of counter 136.

The count read out from counter 136 is supplied to comparators 141 and 142 which are also respectively responsive to signals stored in registers 143 and 144 which are indicative of odometer distances of 22 feet and 26 feet. Comparator 144 includes a pair of output terminals 145 and 146 on which are derived complementary binary signals respectively indicative of the output of counter 136 being greater than and less than the 22-foot signals stored in register 143. Comparator 142 includes a similar pair of output leads 147 and 148 on which are derived complementary signals indicative of the output of counter 136 being less than and greater than the 26-foot signals stored in register 144. The signals derived from leads 146 and 148 are combined with the output signal of divider 137 in AND gate 149, which derives the REJ C signal on lead 136. The signals on leads 145 and 147 are combined with the output signal of divider 137 in AND gate 150, the output of which is the XFER signal derived on lead 89.

To prevent shift register 85 from being responsive to load and shift pulses while vehicle 43 is backing up such that transducer 45 is backing over signpost 14, circuit 152, FIG. 4, is provided. Circuit 152 responds to the LSE pulses on lead 93, as well as the forward and reverse signals on leads 83 and 84, the ENABLE signal on lead 108, the reset signal on lead 90, and the not-Q output of flip-flop 67. Circuit 152 responds to these signals to derive the FRZ signal on lead 88 when transducer 45 is backing up over signpost 14. When transducer 45 has backed completely out of the signpost, circuit 152 responds to these signals to derive the REJ D signal on lead 153.

Figure 9:
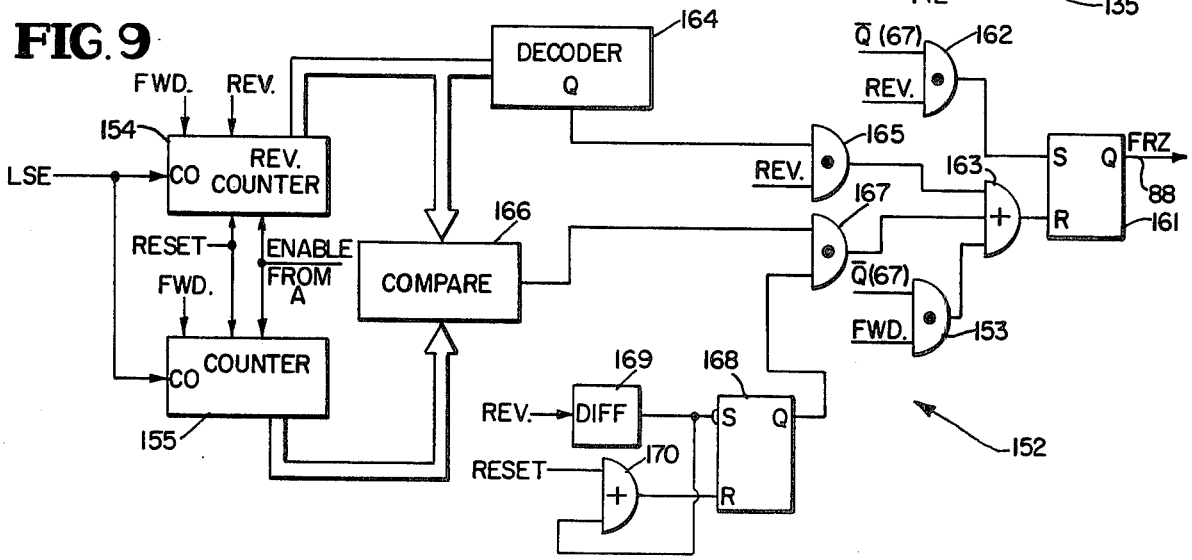
FIG. 9 is a block diagram of a detector to determine that a transducer is backing up over a signpost.

One embodiment of circuit 152 is schematically illustrated in FIG. 9 which includes reversible counter 154 and counter 155. Counters 154 and 155 include count input terminals responsive to the LSE pulses on lead 93. Counter 154 includes increment and decrement input terminals respectively responsive to the FWD and REV signals derived on leads 83 and 84. Counters 154 and 155 are continuously read out while enabled in response to the ENABLE signal derived on lead 108. Counters 154 and 155 are also both reset to 0 in response to the reset signal on lead 90.

Due to the reversible nature of counter 154, it stores, at any instant, a count indicative of the net number of longitudinal regions traversed by detector 45 over a signpost. In contrast, counter 155 stores a count indicative of the farthest extent of transducer 45 into a signpost, because the counter can be advanced only while its increment terminal is activated by the FWD signal on lead 84. When vehicle 43 is backing up over a signpost, the state of counter 155 is not affected by the LSE pulses applied to its count input. Hence, in an exemplary situation, assume that transducer 45 originally traversed a portion of signpost 14 so that it came to a stop between longitudinal regions 24 and 25. Assume that thereafter vehicle 43 was driven in reverse and came to a stop between longitudinal regions 22 and 23. Under these circumstances, counter 154 stores a count of 2, while counter 155 stores a count of 4.

A freeze signal is derived by flip-flop 161 at its Q output terminal, on lead 88, when vehicle 43 is backing up over a signpost. To this end, the set input terminal of shift register 161 is driven by the output of AND gate 162 that is responsive to the REV signal on lead 84, as well as the Q output of flip-flop 67. Flip-flop 161 remains in the set condition until transducer 45 has completely backed out over signpost 14 or until transducer 45 has been advanced over the signpost to the position where it originally stopped and began to back up. Flip-flop 161 is activated to the reset state when transducer 45 begins to move over a signpost in the forward position.

To these ends, the reset input of flip-flop 161 is responsive to three separate signals which are coupled to it through OR gate 163. One input of OR gate 163 is derived when transducer 45 has completely backed out of signpost 14, a condition detected by feeding the output of reversible counter 154 to zero decoder 164, the output of which is combined with the REV signal on lead 84 in AND gate 165, which derives a REJ signal that is applied to one input of OR gate 163. OR gate 163 also is responsive to a binary one signal after transducer 45 has backed up and then come forward to the same position in signpost 14, without going out of the signpost. To this end, the output signals of counters 154 and 155 are supplied to comparator 166, which derives a binary one output when its two inputs are the same. The binary one output of comparator 166 is fed through AND gate 167 to OR gate 163 when the AND gate is enabled after transducer 45 has been backed up and is proceeding in the forward direction over signpost 14. AND gate 167 is enabled in response to the Q output of flip-flop 168, having a set input responsive to the trailing edge of the REV signal on lead 84, which is interpreted as signifying that transducer 45 is beginning forward motion. Flip-flop 168 is activated to the reset state in response to the derivation of either a RESET pulse on lead 90 or the occurrence of a leading edge of the REV signal on lead 84. To these ends, the REV signal on lead 84 is applied to differentiator 169, the output of which is inverted and then applied to the set input of flip-flop 168. A non-inverted replica of the output of differentiator 169 is applied to the reset input of flip-flop 168 via OR gate 170, which is also responsive to the reset signal on lead 90. The final input to OR gate 163 is derived by combining the FWD signal on lead 83 with the not-Q output of flip-flop 67.

The REJ A, REJ B, REJ C, and REJ D signals respectively derived on leads 107, 123, 136, and 153 are combined with a delayed replica of the XFER signal on lead 89, as derived from delay element 171, in OR gate 172, the output of which is the RESET signal derived on lead 90 and which causes all of the circuits in the system to begin a new signpost detection sequence.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. Apparatus for coupling a coded signal from a lane of a roadway to an automotive vehicle traversing the lane comprising a signalling device including: a plurality of polarity coded magnetic pole faces at differing spaced longitudinal regions along the lane, said pole faces at the spaced longitudinal regions being arranged so that there is substantially a magnetic flux null between each adjacent pair of the spaced longitudinal regions, said pole faces being arranged so that at each of the spaced longitudinal regions there is a magnetic field having a substantial amount of vertically directed lines of flux of a single polarity; said vehicle carrying a magnetic flux magnitude transducer positioned to be responsive to magnetic flux derived from the signalling device, said transducer being arranged so that it derives a first waveform including a base line subject to drift due to ambient conditions and a separate pulse as the transducer crosses over each of the regions, the pulses having polarities relative to the base line determined by the polarity of the lines of flux at the region crossed by the transducer, and circuit means responsive to the first waveform for substantially eliminating the base line drift and for deriving a second waveform including bipolarity pulses relative to a substantially constant base line, the polarity of the pulses of the second waveform relative to the constant base line being indicative of the polarity of the lines of flux at each region.

2. The apparatus of claim 1 wherein the circuit means includes negative feedback means responsive to the first waveform for deriving an analog offset signal indicative of the base line drift, said feedback means including: means for combining said offset signal with the first waveform to derive an error signal indicative of the second waveform, and a feedback path responsive to the error signal for controlling the offset signal, and means responsive to the error signal for disabling control of the offset signal by the feedback path and for maintaning the offset signal constant while the transducer is over a signalling device.

3. The apparatus of claim 2 wherein the feedback path includes a bidirectional counter responsive to the second waveform and a source of control pulses so that the counter is respectively driven in first and second directions while variations of first and second polarities occur in the second waveform, and the disabling means includes means for maintaining the count of the counter constant while the transducer is over a signalling device, and means for converting the count of the counter into the analog offset signal.

4. The apparatus of claim 3 wherein the means for maintaining the offset signal constant includes means responsive to the second waveform for deriving first and second signals indicative of the second waveform having opposite polarity levels greater than a predetermined threshold level.

5. Apparatus for coupling a coded signal from a lane of a roadway to an automotive vehicle traversing the lane comprising a signalling device including: a plurality of polarity coded magnetic pole faces at differing spaced longitudinal regions along the lane, said pole faces at the spaced longitudinal regions being arranged so that there is substantially a magnetic flux null between each adjacent pair of the spaced longitudinal regions, said pole faces being arranged so that at each of the spaced longitudinal regions there is a magnetic field having a substantial amount of vertically directed lines of flux of a single polarity; said vehicle carrying a magnetic flux magnitude transducer positioned to be responsive to magnetic flux derived from the signalling device, said transducer being arranged so that it derives a waveform including a separate pulse as the transducer crosses over each of the regions, the pulses having polarities determined by the polarity of the lines of flux at the region crossed by the transducer, an odometer for deriving a signal indicative of vehicle travel distance, and circuit means responsive to the odometer signal and the waveform for recognizing pulses of the waveform as being associated only with a signalling device and for preventing pulses of the waveform that are associated with magnetic anomalies from being recognized as being associated with a signalling device.

6. The apparatus of claim 5 wherein the circuit means includes means for determining that the odometer determined spatial distance associated with each pulse exceeds a predetermined distance.

7. The apparatus of claim 5 wherein the circuit means includes means for determining that the odometer determined spatial distance between the leading and trailing edges of each pulse exceeds a predetermined distance.

8. The apparatus of claim 5 wherein the circuit means includes means for determining that the odometer determined spatial distance between the same portion of each adjacent pulse falls within a predetermined distance determined by the distance between a pair of adjacent longitudinal regions.

9. The apparatus of claim 5 wherein the first means includes means for determining that a predetermined number of pulses occur within a predetermined odometer determined distance indicative of the length of a signalling device, the predetermined number of pulses being determined by the number of bits in a signalling device.

10. Apparatus for coupling a coded signal from a lane of a roadway to an automotive vehicle traversing the lane comprising a signalling device including: a plurality of polarity coded magnetic pole faces at differing spaced longitudinal regions along the lane, said pole faces at the spaced longitudinal regions being arranged so that there is substantially a magnetic flux null between each adjacent pair of the spaced longitudinal regions, said pole faces being arranged so that at each of the spaced longitudinal regions there is a magnetic field having a substantial amount of vertically directed lines of flux of a single polarity; said vehicle carrying a magnetic flux magnitude transducer positioned to be responsive to magnetic flux derived from the signalling device, said transducer being arranged so that it derives a waveform including a separate pulse as the transducer crosses over each of the regions, the pulses having polarities determined by the polarity of the lines of flux at the region crossed by the transducer, an odomoter for deriving a signal indicative of vehicle travel distance, means for deriving first and second signals respectively indicative of the vehicle travelling in the forward and reverse directions, means responsive to the first and second signals, the odometer signal, and the waveform for preventing pulses of the waveform from being recognized as signalling device pulses while the vehicle is travelling over the signalling device in the reverse direction and while the vehicle is travelling over the signalling device toward a position in the signalling device where the vehicle began to travel in reverse.

11. The apparatus of claim 10 wherein the means for preventing includes means for initiating a new signalling device sequence in response to the vehicle travelling in the reverse direction out of the signalling device.

12. Apparatus for coupling a coded signal from a lane of the roadway to an automotive vehicle traversing the lane comprising a signalling device including: a plurality of polarity coded magnetic pole faces at differing spaced longitudinal regions along the lane; said vehicle carrying a magnetic flux transducer positioned to be responsive to magnetic flux derived from the signalling device, said transducer being arranged so that it derives a waveform including a separate pulse in response to the transducer crossing over each of the regions, an odometer for deriving a signal indicative of vehicle travel distance, and circuit means responsive to the odometer signal for recognizing pulses of the waveform as being associated only with a signalling device and for preventing pulses of the waveform that are associated with magnetic anomalies from being recognized as being associated with a signalling device.

13. The apparatus of claim 12 wherein the circuit means includes means for determining that the odometer determined spatial distance associated with each pulse exceeds a predetermined distance.

14. The apparatus of claim 12 wherein the circuit means includes means for determining that the odometer determined spatial distance between the leading and trailing edges of each pulse exceeds a predetermined distance.

15. The apparatus of claim 12 wherein the circuit means includes means for determining that the odometer determined spatial distance between the same portion of each adjacent pulse falls within a predetermined distance determined by the distance between a pair of adjacent longitudinal regions.

16. The apparatus of claim 12 wherein the circuit means includes means for determining that a predetermined number of pulses occur within a predetermined odometer determined distance indicative of the length of a signalling device, the predetermined number of pulses being determined by the number of bits in a signalling device.

17. The apparatus of claim 12 wherein the circuit means is responsive to the waveform.

18. Apparatus for coupling a coded signal from a lane of a roadway to an automotive vehicle traversing the lane comprising a signalling device including: a plurality of polarity coded magnetic pole faces at differing spaced longitudinal regions along the lane; said vehicle carrying a magnetic flux transducer positioned to be responsive to magnetic flux derived from the signalling device, said transducer being arranged so that it derives a waveform including a separate pulse responsive to the transducer crossing over each of the regions, an odometer for deriving a signal indicative of vehicle travel distance, means for deriving first and second signals respectively indicative of the vehicle travelling in the forward and reverse directions, means responsive to the first and second signals, and the odometer signal for preventing pulses of the waveform from being recognized as signalling device pulses while the vehicle is travelling over the signalling device in the reverse direction and while the vehicle is travelling over the signalling device toward a position in the signalling device where the vehicle began to travel in reverse.

19. The apparatus of claim 18 wherein the means for preventing includes means for initiating a new signalling device sequence in response to the vehicle travelling in the reverse direction out of the signalling device.

20. The apparatus of claim 18 wherein the circuit means is responsive to the waveform.

21. Apparatus on an automotive vehicle for detecting a coded signal from a lane of a roadway including a signalling device having: a plurality of polarity coded magnetic pole faces at differing spaced longitudinal regions along the lane, said pole faces at the spaced longitudinal regions being arranged so that there is substantially a magnetic flux null between each adjacent pair of the spaced longitudinal regions, said pole faces being arranged so that at each of the spaced longitudinal regions there is a magnetic field having a substantial amount of vertically directed lines of flux of a single polarity, said detector apparatus comprising a magnetic flux magnitude transducer positioned to be responsive to magnetic flux derived from the signalling device, said transducer being arranged so that it derives a first waveform including a base line subject to drift due to ambient conditions and a separate pulse as the transducer crosses over each of the regions, the pulses having polarities relative to the base line determined by the polarity of the lines of flux at the region crossed by the transducer, and circuit means responsive to the first waveform for substantially eliminating the base line drift and for deriving a second waveform including bipolarity pulses relative to a substantially constant base line, the polarity of the pulses of the second waveform relative to the constant base line being indicative of the polarity of the lines of flux at each region.

22. The apparatus of claim 21 wherein the circuit means includes negative feedback means responsive to the first waveform for deriving an analog offset signal indicative of the base line drift, said feedback means including: means for combining said offset signal with the first waveform to derive an error signal indicative of the second waveform, and a feedback path responsive to the error signal for controlling the offset signal, and means responsive to the error signal for disabling control of the offset signal by the feedback path and for maintaining the offset signal constant while the transducer is over a signalling device.

23. The apparatus of claim 22 wherein the feedback path includes a bidirectional counter responsive to the second waveform and a source of control pulses so that the counter is respectively driven in first and second directions while variations of first and second polarities occur in the second waveform, and the disabling means includes means for maintaining the count of the counter constant while the transducer is over a signalling device, and means for converting the count of the counter into the analog offset signal.

24. The apparatus of claim 23 wherein the means for maintaining the offset signal constant includes means responsive to the second waveform for deriving first and second signals indicative of the second waveform having opposite polarity levels greater than a predetermined threshold level.

25. Apparatus on an automotive vehicle for detecting a coded signal from a lane of a roadway including a signalling device having: a plurality of polarity coded magnetic pole faces at differing spaced longitudinal regions along the lane, said pole faces at the spaced longitudinal regions being arranged so that there is substantially a magnetic flux null between each adjacent pair of the spaced longitudinal regions, said pole faces being arranged so that at each of the spaced longitudinal regions there is a magnetic field having a substantial amount of vertically directed lines of flux of a single polarity; said detector apparatus comprising: a magnetic flux magnitude transducer positioned to be responsive to magnetic flux derived from the signalling device, said transducer being arranged so that it derives a waveform including a separate pulse as the transducer crosses over each of the regions, the pulses having polarities determined by the polarity of the lines of flux at the region crossed by the transducer, an odometer for deriving a signal indicative of vehicle travel distance, and circuit means responsive to the odometer signal and the waveform for recognizing pulses of the waveform as being associated only with a signalling device and for preventing pulses of the waveform that are associated with magnetic anomalies from being recognized as being associated with a signalling device.

26. The apparatus of claim 25 wherein the circuit means includes means for determining that the odometer determined spatial distance associated with each pulse exceeds a predetermined distance.

27. The apparatus of claim 25 wherein the circuit means includes means for determining that the odometer determined spatial distance between the leading and trailing edges of each pulse exceeds a predetermined distance.

28. The apparatus of claim 25 wherein the circuit means includes means for determining that the odometer determined spatial distance between the same portion of each adjacent pulse falls within a predetermined distance determined by the distance between a pair of adjacent longitudinal regions.

29. The apparatus of claim 25 wherein the circuit means includes means for determining that a predetermined number of pulses occur within a predetermined odometer determined distance indicative of the length of a signalling device, the predetermined number of pulses being determined by the number of bits in a signalling device.

30. Apparatus on an automotive vehicle for detecting a coded signal from a lane of a roadway including a signalling device having: a plurality of polarity coded magnetic pole faces at differing spaced longitudinal regions along the lane, said pole faces at the spaced longitudinal regions being arranged so that there is substantially a magnetic flux null between each adjacent pair of the spaced longitudinal regions, said pole faces being arranged so that at each of the spaced longitudinal regions there is a magnetic field having a substantial amount of vertically directed lines of flux of a single polarity; said detector apparatus comprising: a magnetic flux magnitude transducer positioned to be responsive to magnetic flux derived from the signalling device, said transducer being arranged so that it derives a waveform including a separate pulse as the transducer crosses over each of the regions, the pulses having polarities determined by the polarity of the lines of flux at the region crossed by the transducer, an odometer for deriving a signal indicative of vehicle travel distance, means for deriving first and second signals respectively indicative of the vehicle travelling in the forward and reverse directions, means responsive to the first and second signals, the odometer signal, and the waveform for preventing pulses of the waveform from being recognized as signalling device pulses while the vehicle is travelling over the signalling device in the reverse direction and while the vehicle is travelling over the signalling device toward a position in the signalling device where the vehicle began to travel in reverse.

31. The apparatus of claim 44 wherein the means for preventing includes means for initiating a new signalling device sequence in response to the vehicle travelling in the reverse direction out of the signalling device.

* * * * *